US010255834B2

(12) United States Patent
Cok et al.

(10) Patent No.: US 10,255,834 B2
(45) Date of Patent: Apr. 9, 2019

(54) PARALLEL REDUNDANT CHIPLET SYSTEM FOR CONTROLLING DISPLAY PIXELS

(71) Applicant: X-Celeprint Limited, Cork (IE)

(72) Inventors: Ronald S. Cok, Rochester, NY (US); Robert R. Rotzoll, Colorado Springs, CO (US); Christopher Bower, Raleigh, NC (US); Matthew Meitl, Durham, NC (US)

(73) Assignee: X-Celeprint Limited, Cork (IE)

( * ) Notice: Subject to any disclaimer, the term of this patent is extended or adjusted under 35 U.S.C. 154(b) by 355 days.

(21) Appl. No.: 14/807,226

(22) Filed: Jul. 23, 2015

(65) Prior Publication Data

US 2017/0025075 A1 Jan. 26, 2017

(51) Int. Cl.
*G09G 3/20* (2006.01)
*G09G 3/32* (2016.01)

(52) U.S. Cl.
CPC ..... *G09G 3/2003* (2013.01); *G09G 3/32* (2013.01); *G09G 2300/0408* (2013.01); *G09G 2320/0693* (2013.01); *G09G 2330/08* (2013.01)

(58) Field of Classification Search
None
See application file for complete search history.

(56) References Cited

U.S. PATENT DOCUMENTS 4,358,823 A * 11/1982 McDonald ..... G06F 11/1641 714/11
5,022,076 A * 6/1991 Rosenow ..... G06F 11/0757 380/2
5,184,114 A * 2/1993 Brown ..... G09F 9/33 345/600
5,550,066 A 8/1996 Tang et al.
5,621,555 A 4/1997 Park
5,625,202 A 4/1997 Chai
(Continued)

FOREIGN PATENT DOCUMENTS

CN 103677427 A 3/2014
EP 1662301 A1 5/2006
(Continued)

OTHER PUBLICATIONS

Roscher, H., VCSEL Arrays with Redundant Pixel Designs for 10Gbits/s 2-D Space-Parallel MMF Transmission, Annual Report, optoelectronics Department, (2005).
(Continued)

*Primary Examiner* — Kent W Chang
*Assistant Examiner* — Nathaniel P Brittingham
(74) *Attorney, Agent, or Firm* — William R. Haulbrook; Michael D. Schmitt; Choate, Hall & Stewart LLP

(57) ABSTRACT

A parallel redundant integrated-circuit system includes an input connection, an output connection and first and second active circuits. The first active circuit includes one or more first integrated circuits and has an input connected to the input connection and an output connected to the output connection. The second active circuit includes one or more second integrated circuits and is redundant to the first active circuit, has an input connected to the input connection, and has an output connected to the output connection. The second integrated circuits are separate and distinct from the first integrated circuits.

19 Claims, 9 Drawing Sheets

(56) References Cited

U.S. PATENT DOCUMENTS 5,684,368 A * 11/1997 Wei ..... G09G 3/3216 315/169.3
5,706,290 A * 1/1998 Shaw ..... G06F 9/4887 348/586
5,748,161 A 5/1998 Lebby et al.
5,815,303 A 9/1998 Berlin
5,994,722 A 11/1999 Averbeck et al.
6,011,531 A * 1/2000 Mei ..... G09G 3/20 345/90
6,084,579 A 7/2000 Hirano
6,087,680 A 7/2000 Gramann et al.
6,143,672 A 11/2000 Ngo et al.
6,169,294 B1 1/2001 Biing-Jye et al.
6,184,477 B1 2/2001 Tanahashi
6,278,242 B1 8/2001 Cok et al.
6,340,999 B1 1/2002 Masuda et al.
6,392,340 B2 5/2002 Yoneda et al.
6,403,985 B1 6/2002 Fan et al.
6,410,942 B1 6/2002 Thibeault et al.
6,466,281 B1 10/2002 Huang et al.
6,504,180 B1 1/2003 Heremans et al.
6,550,018 B1 * 4/2003 Abonamah ..... G06F 11/165 714/11
6,577,367 B2 6/2003 Kim
6,650,382 B1 11/2003 Sumida et al.
6,660,457 B1 12/2003 Imai et al.
6,703,780 B2 3/2004 Shiang et al.
6,717,560 B2 4/2004 Cok et al.
6,756,576 B1 6/2004 McElroy et al.
6,812,637 B2 11/2004 Cok et al.
6,828,724 B2 12/2004 Burroughes
6,933,532 B2 8/2005 Arnold et al.
6,950,109 B2 * 9/2005 Deering ..... G06F 3/1431 345/589
6,975,369 B1 12/2005 Burkholder
7,009,220 B2 3/2006 Oohata
7,012,382 B2 3/2006 Cheang et al.
7,091,523 B2 8/2006 Cok et al.
7,098,589 B2 8/2006 Erchak et al.
7,129,457 B2 10/2006 McElroy et al.
7,195,733 B2 3/2007 Rogers et al.
7,288,753 B2 10/2007 Cok
7,402,951 B2 7/2008 Cok
7,420,221 B2 9/2008 Nagai
7,420,386 B2 * 9/2008 Wang ..... G11C 7/1048 326/30
7,466,075 B2 12/2008 Cok et al.
7,521,292 B2 4/2009 Rogers et al.
7,557,367 B2 7/2009 Rogers et al.
7,586,497 B2 9/2009 Boroson et al.
7,622,367 B1 11/2009 Nuzzo et al.
7,662,545 B2 2/2010 Nuzzo et al.
7,687,812 B2 3/2010 Louwsma et al.
7,704,684 B2 4/2010 Rogers et al.
7,791,271 B2 9/2010 Cok et al.
7,799,699 B2 9/2010 Nuzzo et al.
7,816,856 B2 10/2010 Cok et al.
7,834,541 B2 11/2010 Cok
7,893,612 B2 2/2011 Cok
7,919,342 B2 4/2011 Cok
7,927,976 B2 4/2011 Menard
7,932,123 B2 4/2011 Rogers et al.
7,943,491 B2 5/2011 Nuzzo et al.
7,969,085 B2 6/2011 Cok
7,972,875 B2 7/2011 Rogers et al.
7,982,296 B2 7/2011 Nuzzo et al.
7,990,058 B2 8/2011 Cok et al.
7,999,454 B2 8/2011 Winters et al.
8,029,139 B2 10/2011 Ellinger et al.
8,039,847 B2 10/2011 Nuzzo et al.
8,198,621 B2 6/2012 Rogers et al.
8,207,547 B2 6/2012 Lin
8,243,027 B2 8/2012 Hotelling et al.
8,261,660 B2 9/2012 Menard
8,288,843 B2 10/2012 Kojima et al.
8,334,545 B2 12/2012 Levermore et al.
8,394,706 B2 3/2013 Nuzzo et al.
8,440,546 B2 5/2013 Nuzzo et al.
8,450,927 B2 5/2013 Lenk et al.
8,470,701 B2 6/2013 Rogers et al.
8,502,192 B2 8/2013 Kwak et al.
8,506,867 B2 8/2013 Menard
8,596,846 B2 12/2013 Yankov et al.
8,664,699 B2 3/2014 Nuzzo et al.
8,686,447 B2 4/2014 Tomoda et al.
8,722,458 B2 5/2014 Rogers et al.
8,735,932 B2 5/2014 Kim et al.
8,754,396 B2 6/2014 Rogers et al.
8,766,970 B2 * 7/2014 Chien ..... G09G 3/3648 345/100
8,791,474 B1 7/2014 Bibl et al.
8,794,501 B2 8/2014 Bibl et al.
8,803,857 B2 * 8/2014 Cok ..... G09G 3/3208 345/204
8,817,369 B2 8/2014 Daiku
8,835,940 B2 9/2014 Hu et al.
8,854,294 B2 10/2014 Sakariya
8,860,051 B2 10/2014 Fellows et al.
8,877,648 B2 11/2014 Bower et al.
8,884,844 B2 11/2014 Yang et al.
8,889,485 B2 11/2014 Bower
8,895,406 B2 11/2014 Rogers et al.
8,902,152 B2 12/2014 Bai et al.
8,946,760 B2 2/2015 Kim
8,987,765 B2 3/2015 Bibl et al.
9,105,813 B1 8/2015 Chang
9,178,123 B2 11/2015 Sakariya et al.
9,202,996 B2 12/2015 Orsley et al.
9,308,649 B2 4/2016 Golda et al.
9,437,782 B2 9/2016 Bower et al.
9,444,015 B2 9/2016 Bower et al.
9,468,050 B1 * 10/2016 Rotzoll ..... G09G 3/3275
9,520,537 B2 12/2016 Bower et al.
9,537,069 B1 1/2017 Bower et al.
9,640,108 B2 * 5/2017 Cok ..... G09G 3/3208
9,818,725 B2 11/2017 Bower et al.
9,930,277 B2 3/2018 Cok
9,991,163 B2 6/2018 Bower et al.
2001/0022564 A1 9/2001 Youngquist et al.
2002/0096994 A1 7/2002 Iwafuchi et al.
2002/0196213 A1 12/2002 Akimoto et al.
2004/0080483 A1 4/2004 Chosa
2004/0180476 A1 9/2004 Kazlas et al.
2004/0189213 A1 9/2004 Okazaki et al.
2004/0212296 A1 10/2004 Nakamura et al.
2004/0227704 A1 * 11/2004 Wang ..... G09G 3/3233 345/76
2004/0252089 A1 12/2004 Ono et al.
2004/0252933 A1 12/2004 Sylvester et al.
2005/0006657 A1 1/2005 Terashita
2005/0012076 A1 1/2005 Morioka
2005/0116621 A1 6/2005 Bellmann et al.
2005/0140275 A1 6/2005 Park
2005/0168987 A1 8/2005 Tamaoki et al.
2005/0264472 A1 12/2005 Rast
2005/0275615 A1 12/2005 Kahen et al.
2006/0139252 A1 * 6/2006 Lee ..... G09G 3/3241 345/76
2007/0033511 A1 * 2/2007 Davies ..... G06F 11/1675 714/799
2007/0035340 A1 2/2007 Kimura
2007/0040764 A1 * 2/2007 Kim ..... G09G 3/3291 345/30
2007/0077349 A1 4/2007 Newman et al.
2007/0170443 A1 * 7/2007 Lee ..... G02F 1/133603 257/85
2007/0201056 A1 8/2007 Cok et al.
2008/0211734 A1 9/2008 Huitema et al.
2009/0278142 A1 11/2009 Watanabe et al.
2009/0315054 A1 12/2009 Kim et al.
2009/0322724 A1 12/2009 Smith

(56) References Cited

U.S. PATENT DOCUMENTS

2010/0060553 A1* 3/2010 Zimmerman ..... H01L 25/0753 345/60
2010/0078670 A1 4/2010 Kim et al.
2010/0109562 A1 5/2010 Shen et al.
2010/0123268 A1 5/2010 Menard
2010/0148198 A1 6/2010 Sugizaki et al.
2010/0149117 A1 6/2010 Chien et al.
2010/0186883 A1 7/2010 Tomoda
2010/0207852 A1 8/2010 Cok
2010/0214245 A1 8/2010 Hirota
2010/0214247 A1 8/2010 Tang et al.
2010/0231528 A1 9/2010 Wolfe et al.
2010/0248484 A1 9/2010 Bower et al.
2010/0258710 A1 10/2010 Wiese et al.
2010/0317132 A1 12/2010 Rogers et al.
2010/0328268 A1 12/2010 Teranishi et al.
2011/0043435 A1 2/2011 Hebenstreit et al.
2011/0073860 A1 3/2011 Kanno et al.
2011/0108800 A1 5/2011 Pan
2011/0211348 A1 9/2011 Kim
2011/0248245 A1 10/2011 Hsieh
2011/0279082 A1 11/2011 Hagenmaier, Jr. et al.
2012/0119230 A1 5/2012 Chan et al.
2012/0119249 A1 5/2012 Kim et al.
2012/0141799 A1 6/2012 Kub et al.
2012/0206421 A1* 8/2012 Cok ..... G09G 3/2085 345/204
2012/0206428 A1 8/2012 Cok
2012/0206499 A1* 8/2012 Cok ..... G09G 3/3208 345/690
2012/0223636 A1 9/2012 Shin et al.
2012/0223875 A1 9/2012 Lau et al.
2012/0228669 A1 9/2012 Bower et al.
2012/0256163 A1 10/2012 Yoon et al.
2012/0314388 A1 12/2012 Bower et al.
2013/0010405 A1 1/2013 Rothkopf et al.
2013/0015483 A1 1/2013 Shimokawa et al.
2013/0069275 A1 3/2013 Menard et al.
2013/0088416 A1* 4/2013 Smith ..... G09G 3/3233 345/76
2013/0196474 A1 8/2013 Meitl et al.
2013/0207964 A1 8/2013 Fleck et al.
2013/0221355 A1 8/2013 Bower et al.
2013/0248829 A1* 9/2013 Smith ..... H01L 51/0031 257/40
2013/0273695 A1 10/2013 Menard et al.
2013/0278513 A1 10/2013 Jang
2014/0082934 A1 3/2014 Cok
2014/0084482 A1 3/2014 Hu et al.
2014/0085214 A1 3/2014 Cok
2014/0104157 A1 4/2014 Burns et al.
2014/0104243 A1 4/2014 Sakariya et al.
2014/0111442 A1 4/2014 Cok et al.
2014/0146273 A1 5/2014 Kim et al.
2014/0175498 A1 6/2014 Lai
2014/0183446 A1 7/2014 Nago et al.
2014/0217448 A1 8/2014 Kim et al.
2014/0231839 A1 8/2014 Jeon et al.
2014/0231851 A1 8/2014 Tsai et al.
2014/0264763 A1 9/2014 Meitl et al.
2014/0267683 A1 9/2014 Bibl et al.
2014/0306248 A1 10/2014 Ahn et al.
2014/0319486 A1 10/2014 Hong
2014/0333676 A1 11/2014 Fujii
2014/0339495 A1 11/2014 Bibl et al.
2014/0346475 A1* 11/2014 Cho ..... H01L 27/326 257/40
2014/0362042 A1 12/2014 Noguchi et al.
2014/0367633 A1 12/2014 Bibl et al.
2014/0367705 A1 12/2014 Bibl et al.
2015/0103070 A1 4/2015 In et al.
2015/0135525 A1 5/2015 Bower
2015/0137153 A1 5/2015 Bibl et al.
2015/0220462 A1 8/2015 Kim et al.
2015/0243203 A1 8/2015 Kim et al.
2015/0263066 A1 9/2015 Hu et al.
2015/0280066 A1 10/2015 Fujimura et al.
2015/0280089 A1 10/2015 Obata et al.
2015/0318328 A1 11/2015 Bibl et al.
2015/0362165 A1 12/2015 Chu et al.
2015/0364107 A1* 12/2015 Sakariya ..... G06F 3/0412 345/174
2015/0371585 A1* 12/2015 Bower ..... G09G 3/32 345/1.1
2015/0371974 A1 12/2015 Bower et al.
2015/0372051 A1 12/2015 Bower et al.
2015/0372052 A1 12/2015 Bower et al.
2015/0372053 A1 12/2015 Bower et al.
2015/0373793 A1 12/2015 Bower et al.
2016/0005721 A1 1/2016 Bower et al.
2016/0018094 A1 1/2016 Bower et al.
2016/0041663 A1* 2/2016 Chen ..... G06F 3/0412 345/174
2016/0043148 A1* 2/2016 Wu ..... H01L 21/77 257/89
2016/0064363 A1 3/2016 Bower et al.
2016/0093600 A1 3/2016 Bower et al.
2016/0266697 A1 9/2016 Cheng et al.
2016/0351539 A1 12/2016 Bower et al.
2016/0358533 A1 12/2016 Rotzoll
2017/0005244 A1 1/2017 Bower et al.
2017/0005280 A1 1/2017 Lee et al.
2017/0061842 A1 3/2017 Cok et al.
2017/0061867 A1* 3/2017 Cok ..... G09G 3/3208
2017/0068362 A1 3/2017 Den Boer et al.
2017/0186356 A1* 6/2017 Cok ..... G09G 3/2014
2017/0186740 A1* 6/2017 Cok ..... H01L 27/0207
2017/0187976 A1* 6/2017 Cok ..... H04N 5/376
2017/0256522 A1* 9/2017 Cok ..... H01L 25/0753
2018/0005565 A1 1/2018 Rotzoll
2018/0182354 A1 6/2018 Radhakrishnan et al.
2018/0191978 A1* 7/2018 Cok ..... G09G 3/3208
2018/0211945 A1 7/2018 Cok et al.
2018/0226386 A1 8/2018 Cok
2018/0261658 A1 9/2018 Cok et al.
2018/0342190 A1 11/2018 Cok et al.

FOREIGN PATENT DOCUMENTS

EP 2078978 A2 7/2009
EP 2148264 A2 1/2010
EP 2703969 A2 3/2014
GB 2 496 183 A 5/2013
JP 11-142878 5/1999
WO WO-2006/027730 A1 3/2006
WO WO-2006/099741 A1 9/2006
WO WO-2008/103931 A2 8/2008
WO WO-2010/032603 A1 3/2010
WO WO-2010/111601 A2 9/2010
WO WO-2010/132552 A1 11/2010
WO WO-2013/064800 A1 5/2013
WO WO-2013/165124 A1 11/2013
WO WO-2014/121635 A1 8/2014
WO WO-2014/149864 A1 9/2014
WO WO-2015/088629 A1 6/2015
WO WO-2015/193434 A2 12/2015
WO WO-2016/030422 A1 3/2016
WO WO-2017/042252 A1 3/2017

OTHER PUBLICATIONS

Yaniv et al., A 640 x 480 Pixel Computer Display Using Pin Diodes with Device Redundancy, 1988 International Display Research Conference, IEEE, CH-2678-1/88:152-154 (1988).
Choi, H. W. et al., Efficient GaN-based Micro-LED Arrays, Mat. Res. Soc. Symp. Proc. 743:L6.28.1-L6.28.6 (2003).
Hamer et al., "63.2: AMOLED Displays Using Transfer-Printed Integrated Circuits," SID 09 Digest, 40(2):947-950 (2009).
Johnson, K. et al., Advances in Red VCSEL Technology, Advances in Optical Technologies, 2012:569379, 13 pages (2012).

(56) References Cited

OTHER PUBLICATIONS

Kasahara, D. et al, Nichia reports first room-temperature blue/'green' VCSELs with current injection, Appl. Phys. Express, 4(7):3 pages (2011).
Koma, N. et al., 44.2: Novel Front-light System Using Fine-pitch Patterned OLED, SID, 08:655-658 (2008).
Lee, S. H. etal, Laser Lift-Offof GaN Thin Film and its Application to the Flexible Light Emitting Diodes, Proc. of SPIE 8460:846011-1-846011-6 (2012).
Poher, V. et al., Micro-LED arrays: a tool for two-dimensional neuron stimulation, J. Phys. D: Appl. Phys. 41:094014 (2008).
Seurin, J.F. et al, High-power red VCSEL arrays, Proc. of SPIE 8639:1-9 (2013).
Yoon, J. et al., Heterogeneously Integrated Optoelectronic Devices Enabled by MicroTransfer Printing, Adv. Optical Mater. 3:1313-1335 (2015).

* cited by examiner

PARALLEL REDUNDANT CHIPLET SYSTEM FOR CONTROLLING DISPLAY PIXELS

FIELD OF THE INVENTION

The present invention relates to integrated-circuit systems having redundant elements connected in parallel.

BACKGROUND OF THE INVENTION

Flat-panel displays are widely used in conjunction with computing devices, in portable devices, and for entertainment devices such as televisions. Such displays typically employ a plurality of pixels distributed over a display substrate to display images, graphics, or text. In a color display, each pixel includes light emitters that emit light of different colors, such as red, green, and blue. For example, liquid crystal displays (LCDs) employ liquid crystals to block or transmit light from a backlight behind the liquid crystals and organic light-emitting diode (OLED) displays rely on passing current through a layer of organic material that glows in response to the current. Displays using inorganic light emitting diodes (LEDs) are also in widespread use for outdoor signage and have been demonstrated in a 55-inch television.

Inorganic light-emitting diode displays using inorganic micro-LEDs on a display substrate are also known. Micro-LEDs can have an area less than 1 mm square, less than 100 microns square, or less than 50 microns square or have an area small enough that it is not visible to an unaided observer of the display at a designed viewing distance. U.S. Pat. No. 8,722,458 entitled *Optical Systems Fabricated by Printing-Based Assembly* teaches transferring light-emitting, light-sensing, or light-collecting semiconductor elements from a wafer substrate to a destination substrate.

Displays are typically controlled with either a passive-matrix (PM) control employing electronic circuitry external to the display substrate or an active-matrix (AM) control employing electronic circuitry formed directly on the display substrate and associated with each light-emitting element. Both OLED displays and LCDs using passive-matrix control and active-matrix control are available. An example of such an AM OLED display device is disclosed in U.S. Pat. No. 5,550,066.

Active-matrix circuits are commonly constructed with thin-film transistors (TFTs) in a semiconductor layer formed over a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors. Additional layers, for example insulating dielectric layers and conductive metal layers are provided, often by evaporation or sputtering, and photolithographically patterned to form electrical interconnections, or wires.

Typically, each display sub-pixel is controlled by one control element, and each control element includes at least one transistor. For example, in a simple active-matrix organic light-emitting diode (OLED) display, each control element includes two transistors (a select transistor and a power transistor) and one capacitor for storing a charge specifying the luminance of the sub-pixel. Each OLED element employs an independent control electrode connected to the power transistor and a common electrode. In contrast, an LCD typically uses a single transistor to control each pixel. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

In any application requiring many elements, it is important that each element is reliable to ensure good manufacturing yields and performance. Active-matrix control circuits, as well as the controlled element (e.g., a light emitter) are subject to failure. Because no manufacturing process is perfect, any large system can have defective elements. To ensure that large multi-element systems are reliably manufactured and operated, such systems can employ redundant elements. For example, displays are sometimes designed with redundant light emitters. U.S. Pat. No. 5,621,555 describes an LCD with redundant pixel electrodes and thin-film transistors to reduce defects. In another approach described in U.S. Pat. No. 6,577,367, an extra row or column of pixels is provided to replace any defective row or column.

An alternative approach to improving display yields uses additional, redundant light-emitting elements, for example two light emitters for every desired light emitter in the display. U.S. Pat. No. 8,766,970 discloses a pixel circuit with two sub-pixels and circuitry to determine whether a sub-pixel is to be enabled, for example if another sub-pixel is faulty. Similarly, U.S. Pat. No. 7,012,382 teaches an LED-based light system that includes a primary light source and at least one redundant light source. The primary light source is activated by itself and the performance of the light source is measured to determine whether or not to drive the redundant light source. The redundant light source is activated when the performance measurements indicate that a performance characteristic is not being met by the primary light source alone. The first light system can be activated in combination with the redundant light source once the decision is made to activate the redundant light source. U.S. Pat. No. 8,791,474 discloses redundant pairs of LED devices driven by a common transistor. WO 2014149864 describes separately controlled LED devices.

Thus, some prior-art designs use additional test or control circuits that require additional space over a substrate to switch between one element and a redundant element, if the one element is faulty. Other prior-art designs have a common controller or driver that can fail. Therefore, these arrangements do not address faults in the control circuits as well as in the light emitters and there remains a need for systems with improved reliability and simple structures.

SUMMARY OF THE INVENTION

The present invention includes embodiments of an integrated-circuit system with parallel redundancy in a simple structure amenable to manufacturing with micro transfer printing. The integrated-circuit system includes redundant circuits with the same functionality that can be provided on separate substrates and are connected in parallel so that each corresponding input of the redundant circuits are connected together and each corresponding output of the redundant circuits are connected together. The system provides redundancy in the presence of printing faults without requiring interconnections between the redundant circuits or control or test circuits for selecting between the redundant circuits and is therefore simple to construct and operate. The redundant circuits can include light emitters and are suitable for forming a display using micro transfer printing.

In one aspect, the disclosed technology includes a parallel redundant integrated-circuit system, the system including: a common input connection; a common output connection; a first active circuit comprising one or more first integrated circuits, the first active circuit having an input connected to the common input connection and an output connected to the common output connection; and a second active circuit comprising one or more second integrated circuits, the second active circuit redundant to the first active circuit and having an input connected to the common input connection and an output connected to the common output connection, wherein the one or more second integrated circuits are separate and distinct from the one or more first integrated circuits.

In certain embodiments, the common input or common output connection is a signal connection.

In certain embodiments, the signal connection is a clock signal connection, a data signal connection, an analog signal connection, or a digital signal connection.

In certain embodiments, the system includes a plurality of common input connections that comprises the common input connection.

In certain embodiments, the system includes a power connection connected to a power input of the first active circuit and a power input of the second active circuit.

In certain embodiments, the system includes a plurality of common output connections that comprises the common output connection.

In certain embodiments, the common input connection is connected to the common output connection through the first and second active circuits or wherein the first and second active circuits include a signal-transfer element and the common input connection is connected to the common output connection through the signal-transfer element.

In certain embodiments, the first active circuit comprises a first light emitter and the second active circuit comprises a second light emitter.

In certain embodiments, the first active circuit comprises a first driver circuit and the second active circuit comprises a second driver circuit.

In certain embodiments, the first active circuit comprises a first red-light emitter that emits red light, a first green-light emitter that emits green light, and a first blue-light emitter that emits blue light; the first driver circuit comprises a first red driver circuit driving the first red-light emitter, a first green driver circuit driving the first green-light emitter, and a first blue driver circuit driving the first blue-light emitter; the second active circuit comprises a second red-light emitter that emits red light, a second green-light emitter that emits green light, and a second blue-light emitter that emits blue light; and the second driver circuit comprises a second red driver circuit driving the second red-light emitter, a second green driver circuit the second green-light emitter, and a second blue driver circuit driving the second blue-light emitter.

In certain embodiments, the first driver circuit comprises a first bit-to-current converter and the second driver circuit comprises a second bit-to-current converter.

In certain embodiments, the first active circuit comprises a first storage element and the second active circuit comprises a second storage element.

In certain embodiments, the system includes a third active circuit comprising one or more third integrated circuits, the third active circuit redundant to the first and second active circuits and having an input connected to the common input connection and an output connected to the common output connection, the third integrated circuits separate and distinct from the first and second integrated circuits.

In certain embodiments, the common input connection, the common output connection, the first active circuit, and the second active circuit form a component group, and the parallel redundant integrated-circuit system comprising a plurality of component groups.

In certain embodiments, the plurality of component groups comprises a first component group and a second component group and wherein the common output connection of the first component group is connected to the common input connection of the second component group.

In certain embodiments, the first and second active circuits of each component group of the plurality of component groups each comprise one or more light emitters.

In certain embodiments, the system includes a controller connected to the plurality of component groups for providing control signals thereto.

In certain embodiments, the second active circuit of at least one component group of the plurality of component groups is a failed active circuit and further including a controller for providing control signals to the plurality of component groups.

In certain embodiments, the system includes a substrate on which the array of component groups are disposed.

In certain embodiments, the substrate is a member selected from the group consisting of polymer, plastic, resin, polyimide, PEN, PET, metal, metal foil, glass, a semiconductor, and sapphire.

In certain embodiments, the substrate has a transparency greater than or equal to 50%, 80%, 90%, or 95% for visible light.

In certain embodiments, the substrate has a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm.

In another aspect, the disclosed technology includes a parallel redundant integrated-circuit system, the system including: a common input connection; a first active circuit comprising one or more first integrated circuits and at least one light emitter, the first active circuit having an input connected to the common input connection; a second active circuit comprising one or more second integrated circuits and at least one light emitter, the second active circuit redundant to the first active circuit and having an input connected to the common input connection; and wherein the second integrated circuits are separate and distinct from the first integrated circuits.

In certain embodiments, the at least one light emitter of the first active circuit comprises a first red-light emitter that emits red light, a first green-light emitter that emits green light, and a first blue-light emitter that emits blue light; and the at least one light emitter of the second active circuit comprises a second red-light emitter that emits red light, a second green-light emitter that emits green light, and a second blue-light emitter that emits blue light.

In certain embodiments, the parallel redundant integrated-circuit system is a display.

In certain embodiments, the input is a signal connection.

In certain embodiments, the signal connection is a clock signal connection, a data signal connection, an analog signal connection, or a digital signal connection.

In certain embodiments, the system includes a plurality of common input connections that comprises the common input connection.

In certain embodiments, the system includes a power connection connected to a power input of the first active circuit and a power input of the second active circuit.

In certain embodiments, the first active circuit comprises a first driver circuit and the second active circuit comprises a second driver circuit.

In certain embodiments, the first active circuit comprises a first red-light emitter that emits red light, a first green-light emitter that emits green light, and a first blue-light emitter that emits blue light; the first driver circuit comprises a first red driver circuit driving the first red-light emitter, a first green driver circuit driving the first green-light emitter, and a first blue driver circuit driving the first blue-light emitter; the second active circuit comprises a second red-light emitter that emits red light, a second green-light emitter that emits green light, and a second blue-light emitter that emits blue light; and the second driver circuit comprises a second red driver circuit driving the second red-light emitter, a second green driver circuit the second green-light emitter, and a second blue driver circuit driving the second blue-light emitter.

In certain embodiments, the first driver circuit comprises a first bit-to-current converter and the second driver circuit comprises a second bit-to-current converter.

In certain embodiments, the first active circuit comprises a first storage element and the second active circuit comprises a second storage element.

In certain embodiments, the system includes a third active circuit comprising one or more third integrated circuits, the third active circuit redundant to the first and second active circuits and having an input connected to the common input connection, the third integrated circuits separate and distinct from the first and second integrated circuits.

In certain embodiments, the common input connection, the first active circuit, and the second active circuit form a component group, and the parallel redundant integrated-circuit system comprising a plurality of component groups.

In certain embodiments, the system includes a controller connected to the plurality of component groups for providing control signals thereto.

In certain embodiments, the second active circuit of at least one component group of the plurality of component groups is a failed active circuit and further including a controller for providing control signals to the plurality of component groups.

In certain embodiments, the system includes a substrate on which the array of component groups are disposed.

In certain embodiments, the substrate is a member selected from the group consisting of polymer, plastic, resin, polyimide, PEN, PET, metal, metal foil, glass, a semiconductor, and sapphire.

In certain embodiments, substrate has a transparency greater than or equal to 50%, 80%, 90%, or 95% for visible light.

In certain embodiments, the substrate has a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm.

In another aspect, the disclosed technology includes a method of calibrating a parallel redundant integrated-circuit system, the method including: providing, by a controller having a memory, a control signal to a plurality of component groups each having a first active circuit and a second active circuit, wherein: each first active circuit comprises a first light emitter and has an input connected to a common input connection and an output connected to a common output connection; and each second active circuit comprises a second light emitter, wherein the second active circuit is redundant to the first active circuit, the second active circuit has an input connected to the common input connection and an output connected to the common output connection, and the second light emitter is separate and distinct from the first light emitter; measuring, by a light measurement and calibration device, light emitted from the component groups; and determining, by the light measurement and calibration device, that the light emitted by a first component group is less than the light emitted by a second component group; storing, in the controller memory, a first calibration value for the first component group and used to calibrate a control signal so that the light emitted light by the first component group is substantially the same as the light emitted by the second component group when the control signal is provided in common to a plurality of component groups including a faulty component group.

In certain embodiments, the first calibration value for a light emitter in the first component group is a factor of two of a second calibration value for a corresponding light emitter in the second component group.

In another aspect, the disclosed technology includes a parallel redundant integrated-circuit display, the display comprising: an array of component groups, each component group having one or more integrated circuits and two or more redundant light emitters having a common input connection and a common output connection, wherein the one or more integrated circuits respond to control signals to drive the two or more light emitters in parallel to emit light, and wherein the two or more redundant light emitters are separate and distinct from each other.

In certain embodiments, the component groups comprise: one or more red-light component groups, the two or more redundant light emitters in each red-light component group comprising two or more redundant red-light emitters that emit red light and have a common input and a common output; one or more green-light component groups, the two or more redundant light emitters in each green-light component group comprising two or more redundant green-light emitters that emit green light and have a common input and a common output; and one or more blue-light component groups, the two or more redundant light emitters in each blue-light component group comprising two or more redundant blue-light emitters that emit blue light and have a common input and a common output.

In certain embodiments, the array of component groups includes 40,000, 62,500, 100,000, 500,000, one million, two million, three million, six million or more component groups.

In certain embodiments, the display includes a display substrate on which the array of component groups are disposed.

In certain embodiments, the display substrate is a member selected from the group consisting of polymer, plastic, resin, polyimide, PEN, PET, metal, metal foil, glass, a semiconductor, and sapphire.

In certain embodiments, display substrate has a transparency greater than or equal to 50%, 80%, 90%, or 95% for visible light.

In certain embodiments, the display substrate has a contiguous display substrate area, the plurality of light emitters each have a light-emissive area, and the combined light-emissive areas of the plurality of light emitters is less than or equal to one-quarter of the contiguous display substrate area.

In certain embodiments, the combined light-emissive areas of the plurality of light emitters is less than or equal to one eighth, one tenth, one twentieth, one fiftieth, one hundredth, one five-hundredth, one thousandth, one two-thousandth, or one ten-thousandth of the contiguous display substrate area.

In certain embodiments, each of the plurality of light emitters has a width from 2 to 5 μm, 5 to 10 μm, 10 to 20 μm, or 20 to 50 μm.

In certain embodiments, each of the plurality of light emitters has a length from 2 to 5 μm, 5 to 10 μm, 10 to 20 μm, or 20 to 50 μm.

In certain embodiments, each of the plurality of light emitters has with a height from 2 to 5 μm, 4 to 10 μm, 10 to 20 μm, or 20 to 50 μm.

In certain embodiments, the display substrate has a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1:
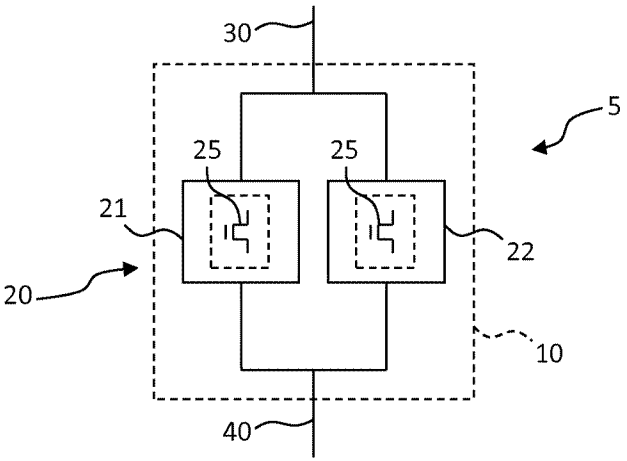
FIG. 1 is a schematic diagram of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 2:
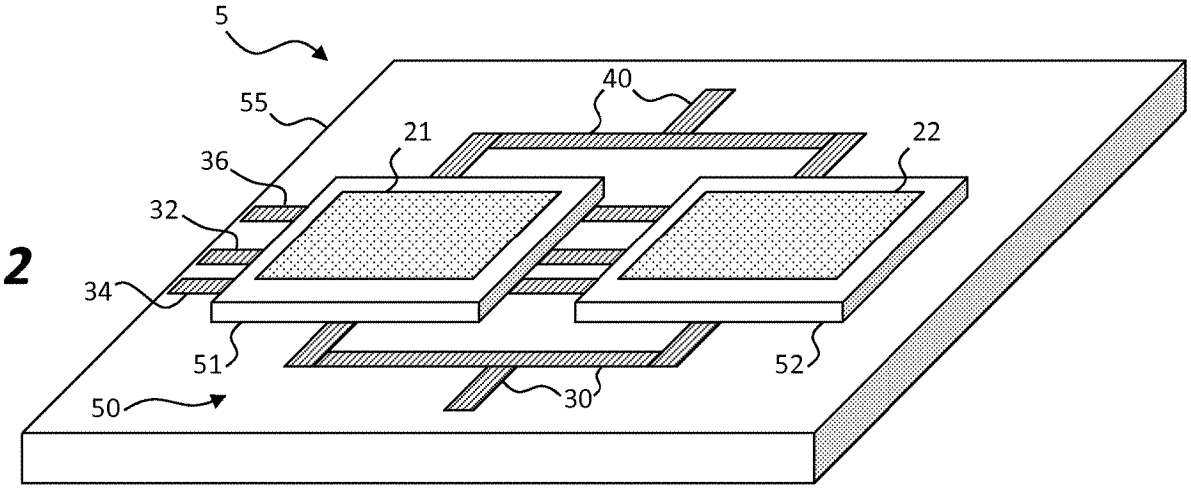
FIG. 2 is a perspective of the embodiment of the FIG. 1.

Referring to the schematic diagram of FIG. 1 and the corresponding perspective of FIG. 2, a parallel redundant integrated-circuit system 5 according to an embodiment of the present invention includes an input connection 30 and an output connection 40. A first active circuit 21 includes one or more first integrated circuits 51 and has an input connected to the input connection 30 and an output connected to the output connection 40. Similarly, a second active circuit 22 includes one or more second integrated circuits 52. The second active circuit 22 is redundant to the first active circuit 21 and also has an input connected to the input connection 30 and an output connected to the output connection 40. Thus, the first and second active circuits 21, 22 have a common input connection 30 and the first and second active circuits 21, 22 have a common output connection 40. The one or more second integrated circuits 52 are separate and distinct from the one or more first integrated circuits 51, for example having separate and independent substrates, having separate electrical contacts, physically separate, are packaged separately in independent packages, or are separate unpackaged dies.

According to embodiments of the present invention, the first and second active circuits 21, 22 are redundant so that they have the same functionality. The first and second active circuits 21, 22 can be similar or identical circuits, can be interchanged with or replace each other, and can be made in first and second integrated circuits 51, 52, respectively that incorporate the same circuits, the same layouts, interconnection arrangements, or that are identical within the limits of an integrated circuit manufacturing process. The first and second active circuits 21, 22 are active circuits 20 that include at least one switching, processing, control, or amplifying element (for example a transistor 25) and are not only resistors, capacitors, or inductors, although such elements can be included in the first and second active circuits 21, 22. The first and second active circuits 21, 22 can also include a common power connection 32 connected to both a power input of the first active circuit 21 and a power input of the second active circuit 22, a ground connection 34 connected to both a ground input of the first active circuit 21 and a ground input of the second active circuit 22, or one or more signal connections connected to both a signal connection of the first active circuit 21 and a signal connection of the second active circuit 22, for example a common clock signal. Alternatively, or in addition, the input or output connections 30, 40 can be signal connections, for example a clock signal connection, a data signal connection, a token connection, an analog signal connection (for example a charge value stored in a capacitor), or a digital signal connection (for example a bit value stored in a latch or flip-flop, such as a D flip-flop). The first and second active circuits 21, 22 can include multiple input or output connections 30, 40. Each input connection 30 is connected in common to corresponding inputs of each of the first and second active circuits 21, 22 and each output connection 40 is connected in common to corresponding outputs of each of the first and second active circuits 21, 22.

In an embodiment of the present invention, a data value provided on the input connection 30 is transferred to the output connection 40. For example, the input of each of the first and second active circuits 21, 22 is connected directly to the output so that the input connection 30 is connected directly to the output connection 40 through both the first and second integrated circuits 51, 52. Alternatively, the data value is transferred through a signal-transfer element that is a portion of each of the first and second active circuits 21, 22. The signal-transfer element can be, for example, a flip-flop or latch that propagates the data value in response to a clock signal useful for synchronization. In another embodiment, the signal-transfer element is an amplifier, for example a transistor 25, which amplifies the data value. Such amplification is useful, for example, if the input or output connections 30, 40 are long wires.

The first and second active circuits 21, 22 can be made in one or more first and second integrated circuits 51, 52 having separate, independent, and distinct substrates. For example, the first and second integrated circuits 51, 52 can be chiplets 50, small, unpackaged integrated circuits such as unpackaged dies interconnected with wires connected to contact pads on the chiplets 50. The chiplets 50 can be disposed on an independent substrate, such as a backplane 55. In an embodiment, the chiplets 50 are made in or on a semiconductor wafer and have a semiconductor substrate and the backplane 55 is or includes glass, resin, polymer, plastic, or metal. Semiconductor materials (for example silicon or GaN) and processes for making small integrated circuits are well known in the integrated circuit arts. Likewise, backplane substrates and means for interconnecting integrated circuit elements on the backplane are well known in the printed circuit board arts. The chiplets 50 (e.g., the first and second integrated circuits 51, 52) can be applied to the backplane 55 using micro transfer printing.

Figure 3:
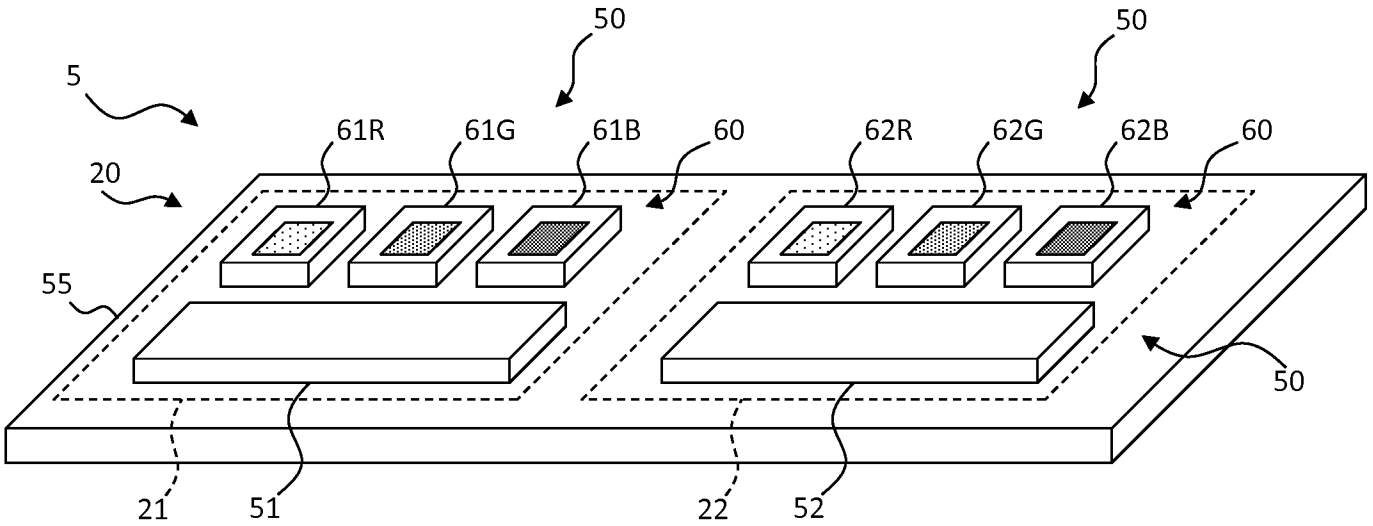
FIG. 3 is a perspective according to an embodiment of the present invention having light emitters.

As shown in the parallel redundant integrated-circuit system 5 of FIG. 3, the first active circuit 21 can include multiple integrated circuits 50, including first integrated circuit 51 and integrated circuits 61R, 61G, and 61B described further below. Similarly, the second active circuit 22 can include multiple integrated circuits 50, including second integrated circuit 52 and integrated circuits 62R, 62G, and 62B described further below. The multiple integrated circuits 50 can have common substrate materials or a variety of different substrate materials including silicon and GaN. In an embodiment, one of the integrated circuits 50 (for example having a silicon semiconductor substrate) in the active circuit 20 is a control or computing element and another of the integrated circuits 50 (for example having a GaN semiconductor substrate) is a light emitter 60. The light emitter 60 can be an inorganic LED. Thus, in this embodiment, the first active circuit 21 includes a first light emitter 60 and the second active circuit 22 includes a second light emitter 60. The first and second light emitters 60 can emit the same color of light, for example to form a monochrome display. In another embodiment, the first active circuit 21 includes three first light emitters 60: first red-light emitter 61R, first green-light emitter 61G, and first blue-light emitter 61B. The second active circuit 22 includes three second light emitters 60: second red-light emitter 62R, second green-light emitter 62G, and second blue-light emitter 62B, as shown in FIG. 3. The first red-light emitter 61R can be identical to, the same as, or similar to the second red-light emitter 62R, the first green-light emitter 61G can be the identical to, the same as, or similar to the second green-light-emitter 62G, and the first blue-light emitter 61B can be the identical to, the same as, or similar to the second blue-light-emitter 62B. Each of the light emitters 60 can have a separate, independent, and distinct substrate and the different light emitters 60 emitting different colors of light can have different substrate materials, for example different semiconductor materials or differently doped semiconductor materials. The three light emitters 60 of each of the first and second active circuits 21, 22 can form a full-color red, green, and blue pixel in a display.

Figure 4:
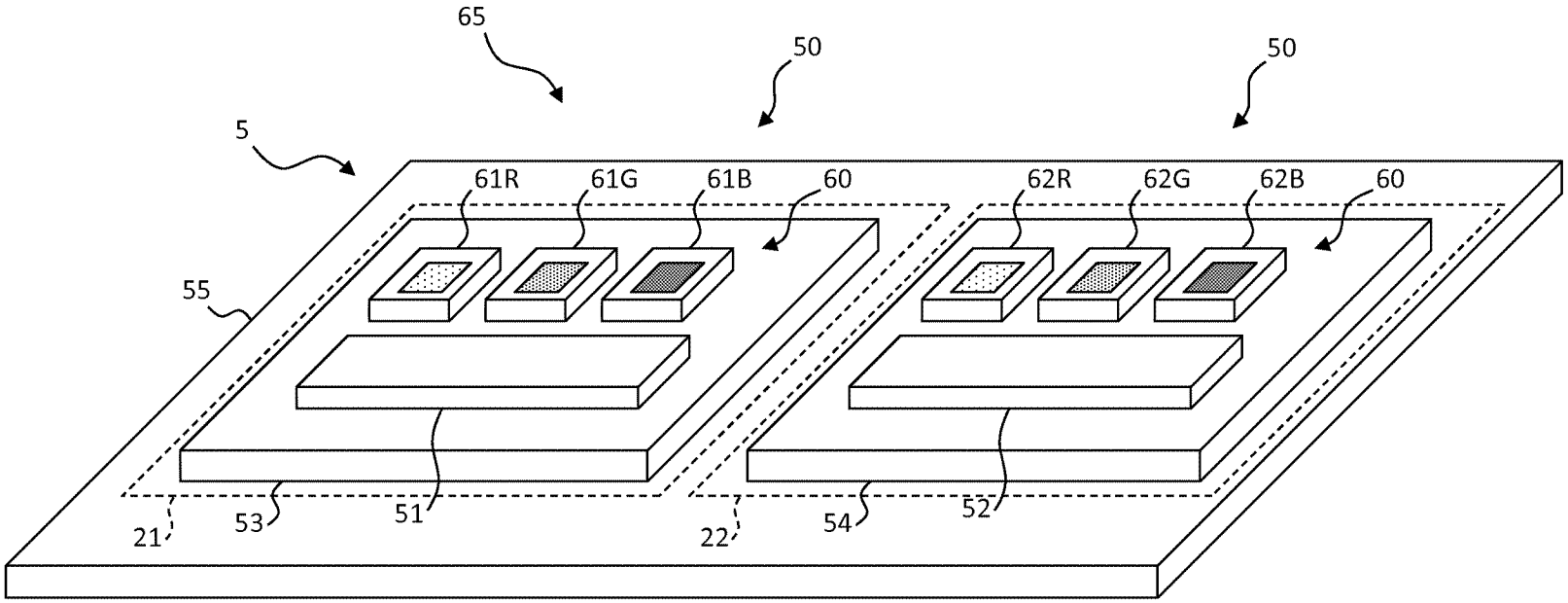
FIG. 4 is a perspective of a display according to an alternative embodiment of the present invention having light emitters and a pixel substrate.

As shown in FIG. 3, the first active circuit 21 includes a plurality of integrated circuits 50 (first integrated circuit 51, first red-light emitter 61R, first green-light emitter 61G, and first blue-light emitter 61B) and the second active circuit 22 includes a plurality of integrated circuits 50 (second integrated circuit 52, second red-light emitter 62R, second green-light emitter 62G, and second blue-light emitter 62B). Each of these integrated circuits has a substrate separate, independent and distinct from the backplane 55 and is disposed directly on the backplane 55, for example by micro transfer printing. In an alternative embodiment of the parallel redundant integrated-circuit system 5 shown in FIG. 4, the integrated circuits 50 of the first and second active circuits 21, 22 are disposed on first and second pixel substrates 53, 54, respectively, for example by micro transfer printing. The first and second pixel substrates 53, 54, are disposed on the backplane 55 and are smaller than, separate, and distinct from the backplane 55. The first and second pixel substrates 53, 54 can, for example, be similar to the backplane 55 (e.g. made of or including glass, resin, metal, or plastic) but in a much smaller size, for example having an area of 50 square microns, 100 square microns, 500 square microns, or 1 square mm and can be only a few microns thick, for example 5 microns, 10 microns, 20 microns, or 50 microns thick.

In one method of the present invention the first and second pixel substrates 53, 54, are disposed on the backplane 55 by micro transfer printing using compound micro assembly structures and methods, for example as described in U.S. Patent Application Ser. No. 62/055,472 filed Sep. 25, 2014, entitled Compound Micro-Assembly Strategies and Devices, the contents of which are hereby incorporated by reference in its entirety. However, since the first and second pixel substrates 53, 54, are larger than the individual integrated circuits 50 in each of the first and second active circuits 21, 22, in another method of the present invention, the first and second pixel substrates 53, 54, are disposed on the backplane 55 using pick-and-place methods found in the printed-circuit board industry, for example using vacuum grippers. The integrated circuits 50 in the first and second active circuits 21, 22 can be interconnected using photolithographic methods and materials or printed circuit board methods and materials. The interconnections are shown in FIGS. 1 and 2, but for clarity are omitted from FIGS. 3 and 4.

In useful embodiments the display substrate 55 includes material, for example glass or plastic, different from a material in an integrated-circuit substrate, for example a semiconductor material such as silicon or GaN. The light emitters 60 can be formed separately on separate semiconductor substrates, assembled onto the first or second pixel substrates 53, 54, and then the assembled unit is located on the surface of the backplane 55. This arrangement has the advantage that the active circuits 20 can be separately tested on the first or second pixel substrate 53, 54 and the first or second pixel substrate 53, 54 accepted, repaired, or discarded before the first or second pixel substrate 53, 54 is located on the backplane 55, thus improving yields and reducing costs.

Figure 5:
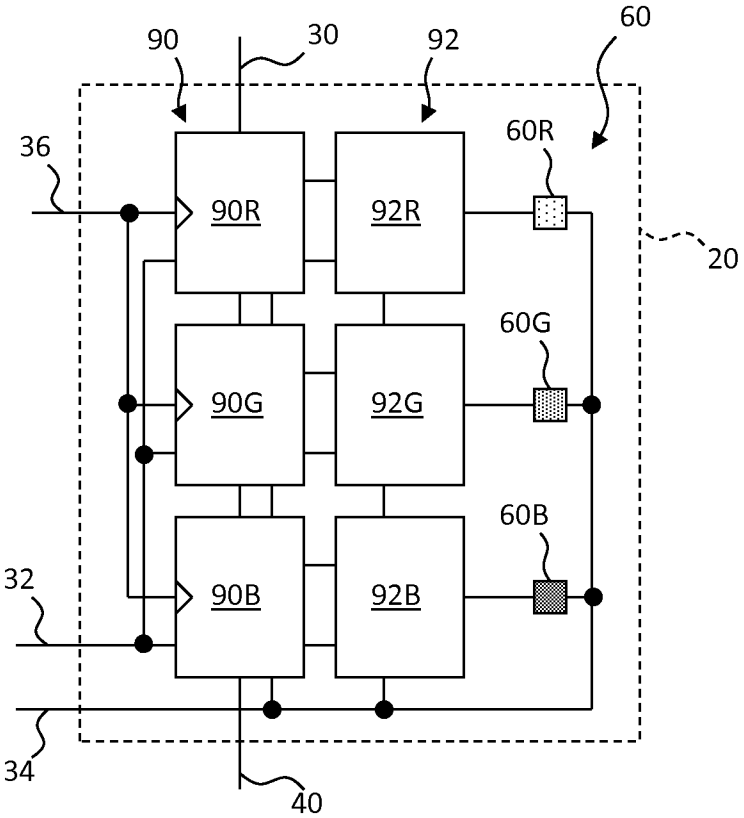
FIG. 5 is a schematic diagram of a circuit according to an embodiment of the present invention.

Referring to FIG. 5, in an embodiment of the present invention, an active circuit 20 (e.g., first active circuit 21 or second active circuit 22) includes first, second, and third storage elements 90 (e.g., red storage element 90R, green storage element 90G, and blue storage elements 90B) for storing three data values corresponding to a desired light output from each of the red-light emitter 60R, the green-light emitter 60G, and the blue-light emitter 60B. The differently colored light emitters 60 can be sub-pixels in a pixel. The data values can be, for example, a single digital bit stored in a latch or a flip-flop (such as a D flip-flop as shown) or a multi-bit value stored in a plurality of latches or flip-flops, such as a register or memory. Alternatively, the storage elements 90 can store analog values, for example in a capacitor (not shown). A red driver circuit 92R drives the red-light emitter 60R with the data value stored in the red storage element 90R, a green driver circuit 92G drives the green-light emitter 60G with the data value stored in the green storage element 90G, and a blue driver circuit 92B drives the blue-light emitter 60B with the data value stored in the blue storage element 90B.

In an embodiment, the driver circuits 92 drive the light emitters 60 with a current-controlled drive signal. The current-controlled drive signal can convert an analog value (e.g., a charge stored in a capacitor storage element 90) to a current drive signal or, as shown, the current-controlled drive signal can convert a digital bit value (e.g., a voltage stored in a flip-flop or latch storage element 90) to a current drive signal, thus forming a bit-to-current converter. Current-drive circuits, such as current replicators, are known in the art and can be controlled with a pulse-width modulation scheme whose pulse width is determined by the digital bit value. A separate driver circuit 92 can be provided for each light emitter 60, as shown, or a common driver circuit 92, or a driver circuit 92 with some common components can be used to drive the light emitters 60 in response to the data values stored in the storage elements 90. Power connection 32, ground connection 34, and clock signal connection 36 control the active circuit 20. Data values are transferred through the storage elements 90 of the active circuit 20 from the input connection 30 to the output connection 40 by clocking the flip-flops to form a serial shift register.

Thus, in an embodiment of the parallel redundant integrated-circuit system 5 of the present invention, the first active circuit 21 includes a first red-light emitter 61R that emits red light, a first green-light emitter 61G that emits green light, and a first blue-light emitter 61B that emits blue light. A first driver circuit 92 comprises a first red driver circuit 92R driving the first red-light emitter 61R, a first green driver circuit 92G driving the first green-light emitter 61G, and a first blue driver circuit 92B driving the first blue-light emitter 61B. The second active circuit 22 includes a second red-light emitter 62R that emits red light, a second green-light emitter 62G that emits green light, and a second blue-light emitter 62B that emits blue light. A second driver circuit 92 comprises a second red driver circuit 92R driving the second red-light emitter 62R, a second green driver circuit 92G the second green-light emitter 62G, and a second blue driver circuit 92B driving the second blue-light emitter 62B. In an embodiment of the present invention, the first driver circuit 92 comprises a first bit-to-current converter and the second driver circuit 92 comprises a second bit-to-current converter. The first active circuit 21 comprises a first storage element 90 and the second active circuit 22 comprises a second storage element 90.

Although the present invention is illustrated with two active circuits 20 (first active circuit 21 and second active circuit 22) that are mutually redundant, in a further embodiment of the present invention (not shown), a third active circuit includes one or more third integrated circuits 50. The third active circuit is redundant to the first and second active circuits 21, 22 and has an input connected to the input connection and an output connected to the output connection. The third integrated circuits are separate and distinct from the first and second integrated circuits 51, 52. Providing a third active circuit further reduces the likelihood of a fault rendering the parallel redundant integrated-circuit system 5 unusable.

Figure 6:
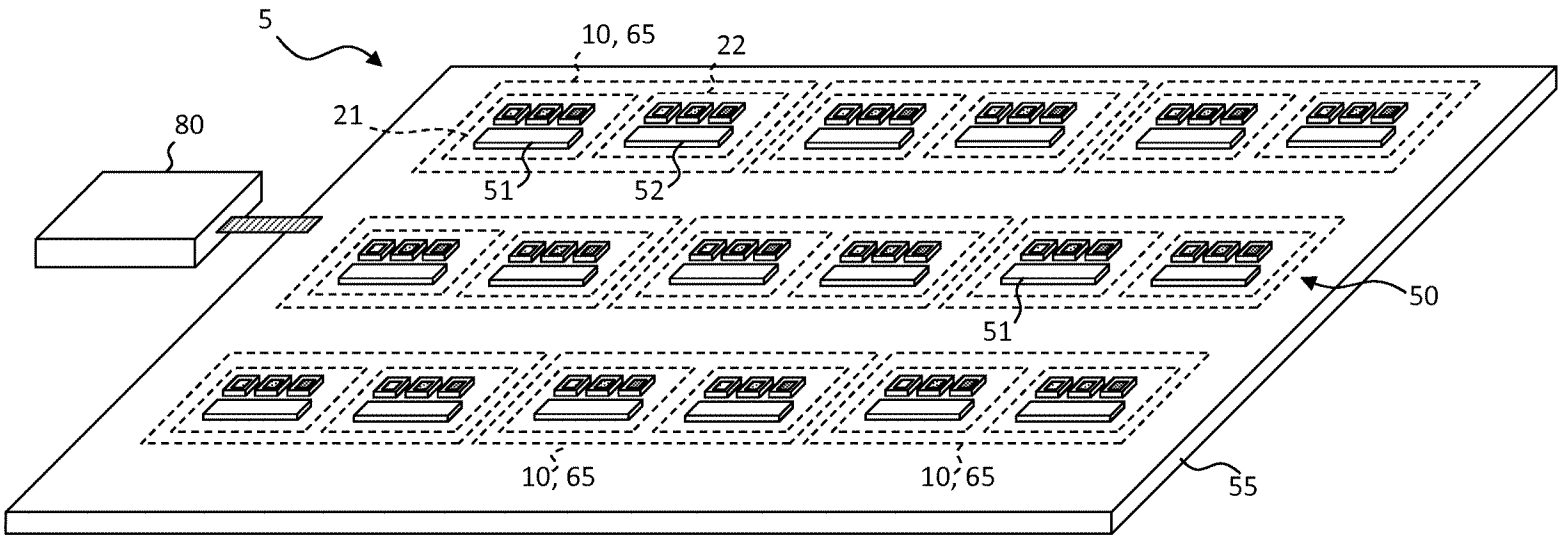
FIG. 6 is a perspective of a display according to an embodiment of the present invention.
Figure 7:
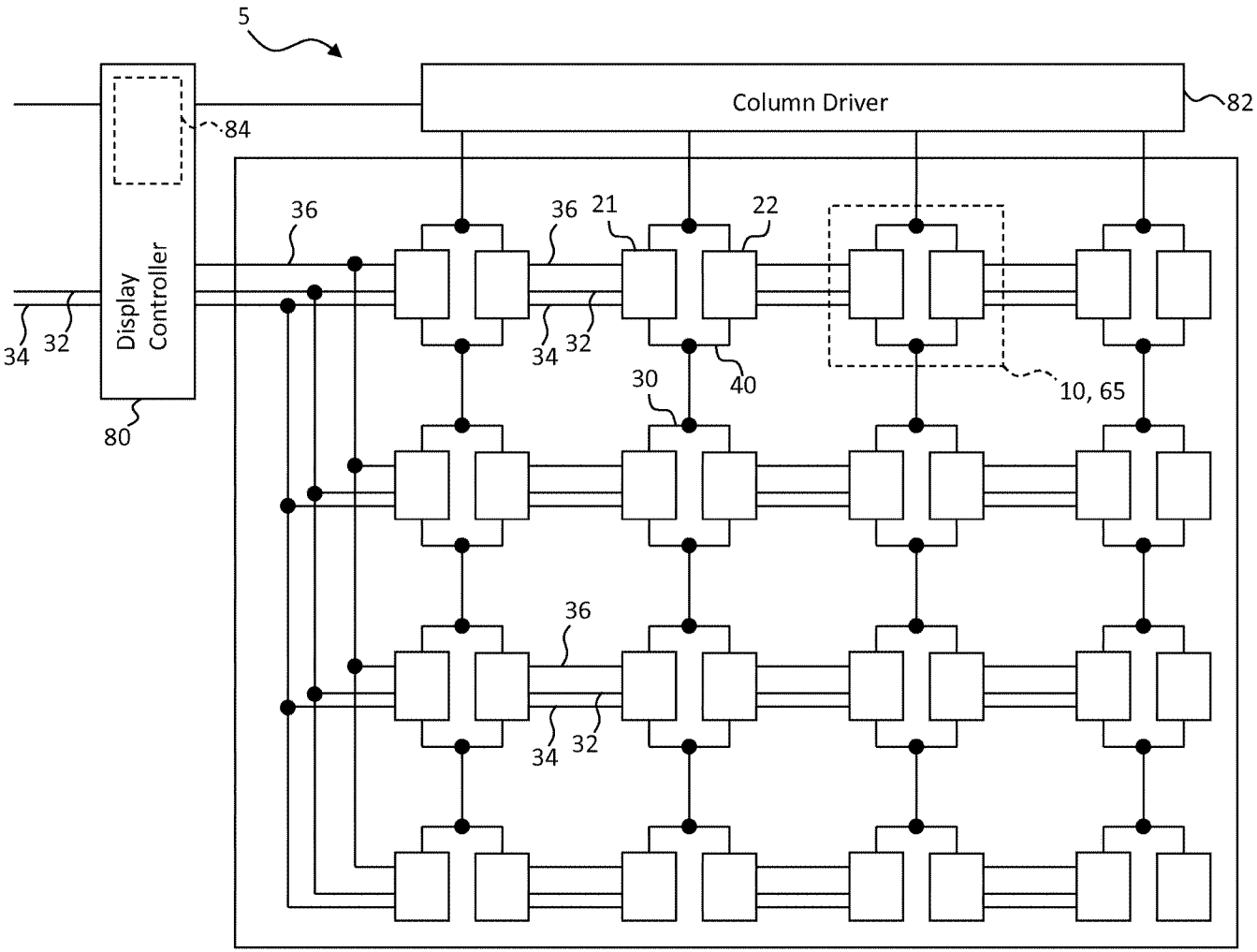
FIG. 7 is a schematic diagram of a display embodiment of the present invention.

Referring next to the perspective of FIG. 6 and corresponding schematic diagram of FIG. 7, the input connection 30, the output connection 40, the first active circuit 21, and the second active circuit 22 form a component group 10 that, in this embodiment, is also a redundant full-color pixel 65 including red, green and blue colors. (In further embodiments, the redundant full-color pixels 65 can include additional colors and the first and second active circuits 21, 22 include additional light emitters 60 emitting light of additional colors, such as yellow or cyan.) In a further embodiment, the parallel redundant integrated-circuit system 5 of the present invention includes a plurality of component groups 10. Each component group 10 includes a redundant pair of first and second active circuits 21, 22, each with one or more, for example three, light emitters 60 (FIG. 3), has redundant first and second integrated circuits 51, 52, and forms the redundant full-color pixel 65. Thus, in an embodiment, the first and second active circuits 21, 22 of each component group 10 of the plurality of component groups 10 each comprise one or more light emitters 60.

The parallel redundant integrated-circuit system 5 can include a controller 80 connected to the plurality of component groups 10 for providing control signals to the component groups 10. The component groups 10 can be arranged in a regular array to form a display and the controller 80 can be a display controller 80 that provides signals to the input connections 30 of the component groups 10 to drive the light emitters 60 of the component groups 10. In this arrangement, the plurality of component groups 10 includes a first component group 10 and a second component group 10 and the output connection 40 of the first component group 10 is connected to the input connection 30 of the second component group 10, for example to form a column (or row, not shown) of serially connected component groups 10 capable of transferring data values along the column.

The display controller 80 can include a memory 84 for storing calibration and display pixel values for the display that are communicated to a column driver 82. The column driver 82 passes the display pixel values down the columns of component groups 10 to display an image. Because the display pixel values, in this embodiment, are shifted down the column of component groups 10, for example with storage elements 90 (FIG. 5) row select control lines for the display are not necessary.

According to the present invention, manufacturing processes are imperfect and can result in faulty circuits or circuit elements. If both the first and second active circuits 21, 22 in a component group 10 are operating normally, both will emit light according to their input connections 30. If one of the first and second active circuits 21, 22 fails to emit light, either because of a faulty LED or faulty circuitry, the other of the first and second active circuits 21, 22, will emit light according to its input connections 30. Thus, if any of the light emitters 60 or an active circuit 20 fails, the redundant active circuit 20 can continue to operate.

Figure 8B:
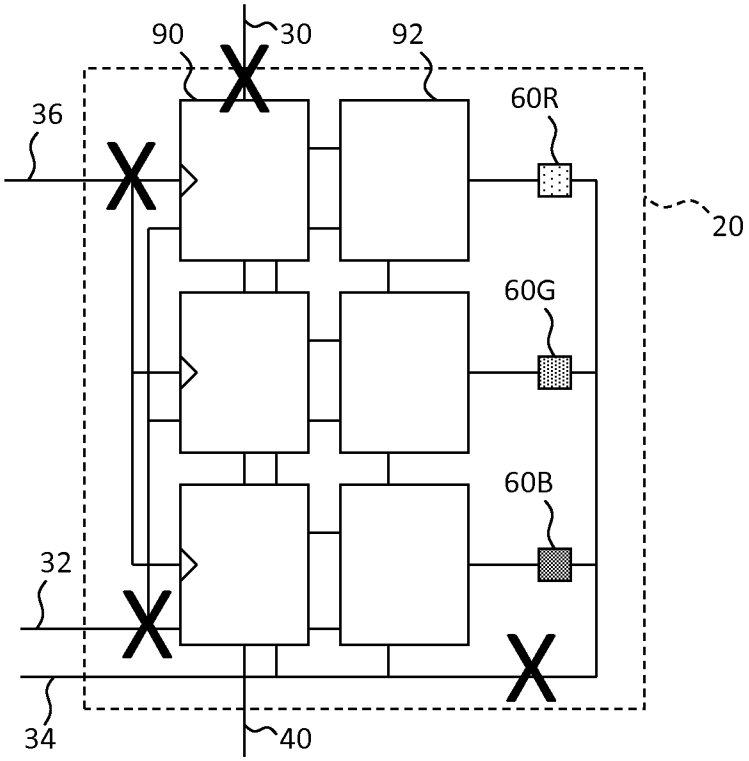
FIGS. 8A and 8B are schematic illustrations of faulty circuits according to embodiments of the present invention.
Figure 8A:
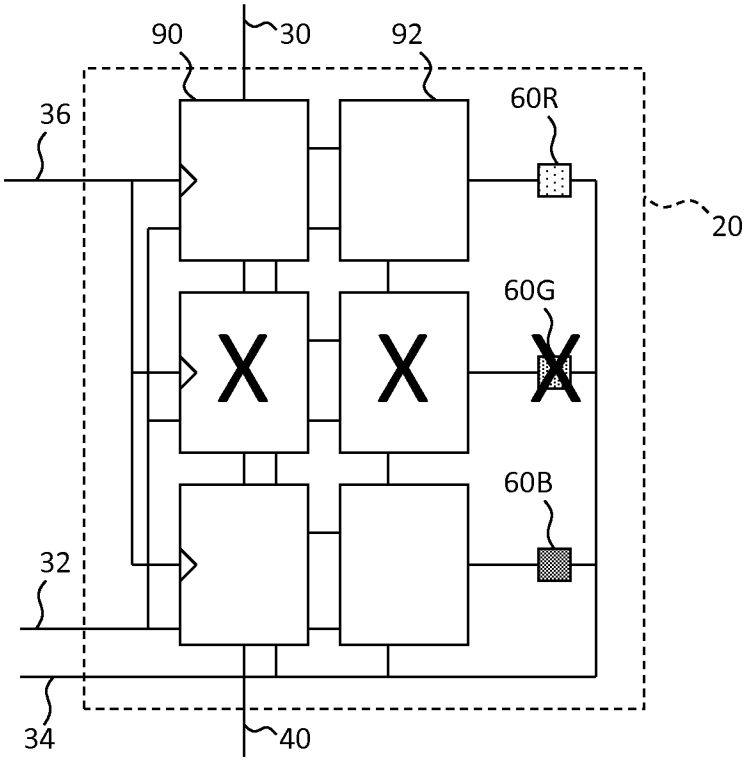

As shown in FIGS. 8A and 8B, a variety of different faults are possible. Referring to FIG. 8A, a single LED, a single storage element 90, or a driver circuit 92 is faulty, for example having an electrical short or open as indicated with the X marks. This fault results in the single LED (e.g., the green-light emitter 60G) failing to operate properly although the remaining LEDs (e.g., the red-light and blue-light emitters 60R, 60B) do. In this example, both redundant red-light emitters 60R and blue-light emitters 60B in the component group 10 will operate normally although only one green-light emitter 60G will operate. In contrast, referring to FIG. 8B, a signal connection such as the input connection 30, the clock signal connection 36, the power connection 32, or the ground connection 34 is faulty as indicated with the X marks. In this example all three of the 60R, the green-light emitter 60G, and the blue-light emitter 60B will fail so that only red-light emitter 60R, the green-light emitter 60G, and blue-light emitter 60B of the redundant pair of first and second active circuits 21, 22 in the component group 10 will emit light.

Figure 9:
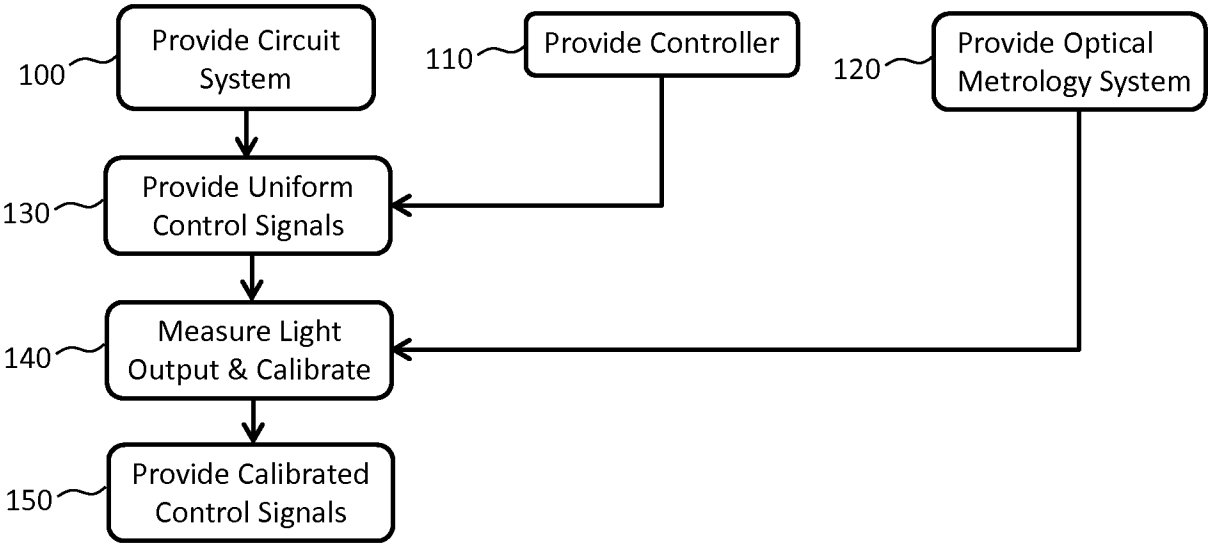
FIG. 9 is a flow chart illustrating a method of the present invention.

Because the first and second active circuits 21, 22 of a component group 10 with a faulty storage element 90, drive circuit 92, or light emitter 60 will emit less light than a normally operating component group 10 when driven with a common signal, a calibration is performed to enable uniform light output from the plurality of component groups 10 when the plurality of component groups 10 are controlled with a common signal. Referring to the method illustrated by the flow diagram of FIG. 9, in an embodiment the circuit system is provided in step 100, the controller 80 is provided in step 110, and an optical metrology system, for example a light measurement and calibration device including one or more light sensors responsive to different colors of light, is provided in step 120. The circuit system can include a plurality of component groups 10 in a display as illustrated in FIGS. 6 and 7.

Although not specifically illustrated in the Figures or as a method step, the provision of the circuit system can include forming conductive wires on the backplane 55 using photolithographic and display substrate processing techniques, for example photolithographic processes employing metal or metal oxide deposition using evaporation or sputtering, curable resin coatings (e.g. SU8), positive or negative photoresist coating, radiation (e.g. ultraviolet radiation) exposure through a patterned mask, and etching methods to form patterned metal structures, vias, insulating layers, and electrical interconnections. Inkjet and screen-printing deposition processes and materials can be used to form patterned conductors or other electrical elements. The electrical interconnections, or wires, can be fine interconnections, for example having a width of less than 50 microns, less than 20 microns, less than 10 microns, less than five microns, less than two microns, or less than one micron. Such fine interconnections are useful for interconnecting chiplets 50, for example as bare dies with contact pads and used with the first or second pixel substrates 53, 54. Alternatively, wires can include one or more crude lithography interconnections having a width from 2 μm to 2 mm, wherein each crude lithography interconnection electrically connects the first or second pixel substrates 53, 54 to the backplane 55.

The redundant light emitters 60 are electrically connected to one or more electrically conductive wires that electrically connect the redundant light emitters 60 and the active circuits 20 to conduct power, a ground reference voltage, or signals for controlling the light emitters 60. In an embodiment, the conductive wires are connected to a display controller 80 that is external to the display substrate backplane 55. In an alternative embodiment, not shown, the display controller 80 is located on the display substrate backplane 55 outside the display substrate area. The display controller 80 controls the parallel redundant integrated-circuit system 5 by, for example, providing power, a ground reference signal, and control signals.

In an embodiment, the light emitters 60 (e.g. micro-LEDs) are transfer printed to the first or second pixel substrates 53, 54 or the backplane 55 in one or more transfers. For a discussion of micro-transfer printing techniques see, U.S. Pat. Nos. 8,722,458, 7,622,367 and 8,506,867, the contents of each of which is hereby incorporated by reference in their entirety. The transferred light emitters 60 are then interconnected, for example with conductive wires and optionally including connection pads and other electrical connection structures, to enable the display controller 80 to electrically interact with the light emitters 60 to emit light in the parallel redundant integrated-circuit system 5 of the present invention. In an alternative process, the transfer of the light emitters 60 is performed before or after all of the conductive wires are in place. Thus, in embodiments the construction of the conductive wires can be performed before the light emitters 60 are printed or after the light emitters 60 are printed or both. In an embodiment, the display controller 80 is externally located (for example on a separate printed circuit board substrate) and electrically connected to the conductive wires using connectors, ribbon cables, or the like. Alternatively, the display controller 80 is affixed to the backplane 55 outside the display substrate area and electrically connected to the conductive wires using wires and buses, for example using surface mount and soldering technology.

The controller 80, for example a display controller 80, provides uniform control signals for the plurality of display component groups 10 in step 130. However, because of manufacturing or operating faults, at least one of the component groups 10 emits less light than another component group 10. This difference in emitted light is measured by the optical metrology system and a calibration value computed for one or more component groups 10 in step 140, for example by determining that the light emitted by a first component group 10 is less than the light emitted by a second component group 10. The calibration values can be stored in the display controller 80 memory 84. For example, a first calibration value for the first component group 10 is stored such that the light emitted light by the first component group 10 is substantially the same as the light emitted by the second component group 10 when the control signal is provided in common for a plurality of component groups 10 including a faulty component group 10. By substantially the same is meant that the component groups 10 emit the same amount of light within the variability of the normally operating LED and circuit components.

The display controller 80 then provides calibrated control signals to the array of component groups 10 in step 150, for example by using a lookup table to convert an input control signal to a calibrated output control signal. The display can then operate normally by receiving an external image signal, converting it to a calibrated image signal using the controller 80 and the calibration values stored in the memory 84, and then providing the calibrated image signal to the component groups 10 through the column driver 82. (As is well understood by those knowledgeable in the art, rows and columns are arbitrary designations that can be interchanged.) For example, in the case of a fault shown in FIG. 8B in which all three light emitters fail, the calibrated output control signal for the faulty component group 10 can specify a driving value for each of the three red-, green-, and blue-light emitters 60R, 60G, 60B that is two times greater than the driving value for a normally operating component group 10. Thus, the remaining functional active circuit 20 will emit twice as much light so that the same amount of light is emitted from the one functional active circuit 20 in the faulty component group 10 as is emitted from both of the active circuits 20 of the normally operating component group 10. In the case of a fault shown in FIG. 8A in which only one of the three light emitters fails, the calibrated output control signal for the faulty component group 10 can specify a driving value for the faulty red-, green-, or blue-light emitter 60R, 60G, 60B that is two times greater than the driving value for the corresponding red-, green, or blue-light emitter 60R, 60G, 60B of a normally operating component group 10. Thus, the light emitter 60 of the fully functional active circuit 20 corresponding to the faulty light emitter of the faulty active circuit 20 will emit twice as much light so that the same amount of light is emitted from the one functional active circuit 20 in the faulty component group 10 as is emitted from both of the active circuits 20 of the normally operating component group 10. Thus, in this embodiment, a first calibration value for a first component group 10 is a factor of two of a second calibration value for a second component group 10. In the example of FIG. 8A, the green-light emitter 60G of the normally operating active circuit 20 will be driven to emit twice as much light to compensate for the faulty green-light emitter 60G of the faulty component group 10. The red- and blue-light emitters 60R and 60B of both active circuits 20 will emit the usual amount of light. In this embodiment, a first calibration value for a light emitter in the first component group 10 is a factor of two of a second calibration value for a corresponding light emitter in the second component group 10. In an embodiment, all of the light emitters 60 in a component group 10 are spatially located close enough together that they cannot be resolved by the human visual system at a designed viewing distance.

Referring back to FIGS. 6 and 7, the last row of component groups 10 does not require an output connection 40 to pass along data since there are no component groups 10 below it in the display. Furthermore, in an alternative design, data values are not sequentially shifted through the active circuits 20 of the component groups 10 but are provided in parallel to all of the component groups 10 and row control signals, either internal or external to the display, select the row of component groups 10 that store the data values, for example by controlling a clock signal to shift the data values into the storage elements 90 in the row. In such a design, no output connections 40 are needed.

Therefore, in an alternative embodiment of the present invention, a parallel redundant integrated-circuit system 5 includes an input connection 30 and a first active circuit 21 comprising one or more first integrated circuits 51. The first active circuit 21 has an input connected to the input connection 30 and includes at least one light emitter 60. A second active circuit 22 comprises one or more second integrated circuits 52. The second active circuit 22 is redundant to the first active circuit 21, has an input that is also connected to the same input connection 30, and includes at least one light emitter 60. The second integrated circuits 52 are separate and distinct from the first integrated circuits 51. In one embodiment, the at least one light emitter 60 of the first active circuit 21 comprises a first red-light emitter 61R that emits red light, a first green-light emitter 61G that emits green light, and a first blue-light emitter 61B that emits blue light. Similarly, the at least one light emitter 60 of the second active circuit 22 comprises a second red-light emitter 62R that emits red light, a second green-light emitter 62G that emits green light, and a second blue-light emitter 62B that emits blue light. The light emitters 60 can be arranged in an array so that the parallel redundant integrated-circuit system 5 is a display.

Figure 10:
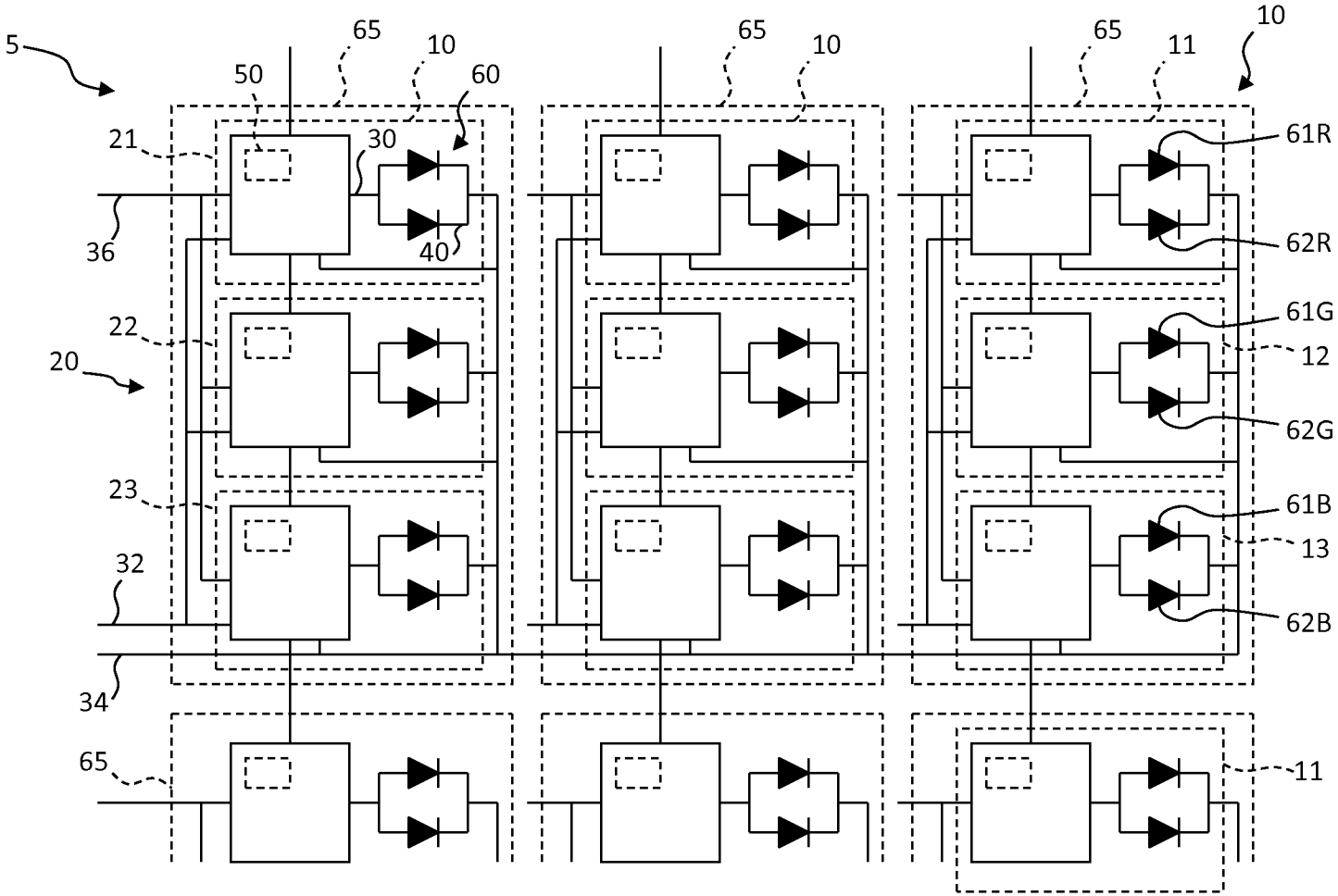
FIG. 10 is a schematic diagram of an alternative embodiment of the present invention.

In the embodiment illustrated in FIG. 3, each active circuit 20 includes a triplet of red-light, green-light, and blue-light emitters 60 and redundant pairs of active circuits 20 are provided in each component group 10 to form a redundant full-color pixel 65. Each component group 10 corresponds to a redundant full-color pixel 65. Referring to FIG. 10, in an alternative embodiment each active circuit 20 includes two or more redundant light emitters 60 connected in parallel with common input connections 30 and output connections 40 to form a component group 10 and a triplet of red-light, green-light, and blue-light emitting component groups 10 with first, second, and third active circuits 21, 22, 23 forms a redundant full-color pixel 65.

In this alternative embodiment, a parallel redundant integrated-circuit system 5 is a display including an array of component groups 10. Each component group 10 includes one or more integrated circuits 50 and two or more redundant light emitters 60 having a common input connection 30 and a common output connection 40. The two or more redundant light emitters 60 are separate and distinct from each other, for example having separate and independent substrates of the same or different substrate materials. The one or more integrated circuits 50 respond to control signals to drive the light emitters 60 in parallel to emit light. As noted with respect to FIG. 4, in this embodiment, each active circuit 20 (corresponding to a component group 10) can be provided on a separate and distinct pixel substrate (e.g., pixel substrate 53 or 54).

As shown in FIG. 10, the parallel redundant integrated-circuit system 5 forms a display that includes one or more red-light component groups 11, green-light component groups 12, and blue-light component groups 13. The two or more redundant light emitters 60 in each red-light component group 11 comprise two or more redundant first and second red-light emitters 61R, 62R that emit red light and have a common input connection 30 and a common output connection 40. The two or more redundant light emitters 60 in each green-light component group 12 comprise two or more redundant first and second green-light emitters 61G, 62G that emit green light and have a common input connection 30 and a common output connection 40. The two or more redundant light emitters 60 in each blue-light component group 13 comprise two or more redundant first and second blue-light emitters 61B, 62B that emit blue light and have a common input connection 30 and a common output connection 40. The two or more redundant light emitters 60 in each component group 10 are functionally the same (within the variability of a manufacturing process), are driven together with the same signals, and are calibrated in the same step and with the same calibration value. The two or more redundant light emitters 60 in each component group 10 can be identical components within the variability of a manufacturing process.

In an embodiment of the present invention, an array of component groups 10 (e.g., as in FIG. 6 or 10) can include 40,000, 62,500, 100,000, 500,000, one million, two million, three million, six million or more component groups 10, for example for a quarter VGA, VGA, or HD display having various resolutions. In an embodiment of the present invention, the light emitters 60 can be considered integrated circuits 50, since they are formed in a substrate using integrated-circuit processes.

According to various embodiments of the present invention, the parallel redundant integrated-circuit system 5, for example as used in a display, can include a display substrate on which the array of component groups 10 are disposed. For example, the backplane 55 can be a display substrate 55, as shown in FIGS. 2-4, and 6. The display substrate 55 usefully has two opposing smooth sides suitable for material deposition, photolithographic processing, or micro-transfer printing of micro-LEDs. The display substrate 55 can have a size of a conventional display, for example a rectangle with a diagonal of a few centimeters to one or more meters. Such substrates are commercially available. The display substrate 55 can include polymer, plastic, resin, polyimide, PEN, PET, metal, metal foil, glass, a semiconductor, or sapphire and have a a transparency greater than or equal to 50%, 80%, 90%, or 95% for visible light. In some embodiments of the present invention, the light emitters 60 emit light through the display substrate 55. In other embodiments, the light emitters 60 emit light in a direction opposite the display substrate 55. The display substrate 55 can have a thickness from 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm. According to embodiments of the present invention, the display substrate 55 can include layers formed on an underlying structure or substrate, for example a rigid or flexible glass or plastic substrate.

In an embodiment, the display substrate 55 can have a single, connected, contiguous display substrate area that includes the light emitters 60 and the light emitters 60 each have a light-emissive area. The combined light-emissive areas of the plurality of light emitters 60 is less than or equal to one-quarter of the contiguous display substrate area. In further embodiments, the combined light-emissive areas of the plurality of light emitters 60 is less than or equal to one eighth, one tenth, one twentieth, one fiftieth, one hundredth, one five-hundredth, one thousandth, one two-thousandth, or one ten-thousandth of the contiguous display substrate area. The light-emissive area of the light emitters 60 can be only a portion of the light emitter 60. In a typical light-emitting diode, for example, not all of the semiconductor material in the light-emitting diode necessarily emits light. Therefore, in another embodiment, the light emitters 60 occupy less than one quarter of the display substrate area.

In an embodiment of the present invention, the light emitters 60 are micro-light-emitting diodes (micro-LEDs), for example having light-emissive areas of less than 10, 20, 50, or 100 square microns. In other embodiments, the light emitters 60 have physical dimensions that are less than 100 μm, for example having a width from 2 to 5 μm, 5 to 10 μm, 10 to 20 μm, or 20 to 50 μm, having a length from 2 to 5 μm, 5 to 10 μm, 10 to 20 μm, or 20 to 50 μm, or having a height from 2 to 5 μm, 4 to 10 μm, 10 to 20 μm, or 20 to 50 μm. The light emitters 60 can have a size of one square micron to 500 square microns. Such micro-LEDs have the advantage of a small light-emissive area compared to their brightness as well as color purity providing highly saturated display colors and a substantially Lambertian emission providing a wide viewing angle.

According to various embodiments, the parallel redundant integrated-circuit system 5, for example as used in a display of the present invention, includes a variety of designs having a variety of resolutions, light emitter 60 sizes, and displays having a range of display substrate areas. For example, display substrate areas ranging from 1 cm by 1 cm to 1 m by 1 m in size are contemplated. In general, larger light emitters 60 are most useful, but are not limited to, larger display substrate areas. The resolution of light emitters 60 over a display substrate can also vary, for example from 50 light emitters 60 per inch to hundreds of light emitters 60 per inch, or even thousands of light emitters 60 per inch. For example, a three-color display can have one thousand 10μ×10μ light emitters 60 per inch (on a 25-micron pitch). Thus, the present invention has application in both low-resolution and very high-resolution displays. An approximately one-inch 128 by 128 pixel display having 3.5 micron by 10-micron emitters has been constructed and successfully operated without redundant emitters as described in U.S. Patent Application Ser. No. 62/148,603 filed Apr. 16, 2015, entitled Micro-Assembled Micro LED Displays and Lighting Elements, the contents of which are hereby incorporated by reference in its entirety.

As shown in FIGS. 6 and 7, the redundant full-color pixels 65 form a regular array on the display substrate 55. Alternatively, at least some of the redundant full-color pixels 65 have an irregular arrangement on the display substrate 55. The active circuits 20 can be pixel controllers or light-emitter controllers electrically connected to the light emitters 60 (for example the red-light emitter 61R or 62R, the green-light emitter 61G or 62G, or the blue-light emitter 61B or 62B) to control the light output of the one or more light emitters 60, for example in response to control signals from the display controller 80 through conductive wires formed on the display substrate 55.

In an embodiment, the integrated circuits 50 are formed in substrates or on supports separate from the display substrate 55. For example, the light emitters 60 are separately formed in a semiconductor wafer. The light emitters 60 are then removed from the wafer and transferred, for example using micro transfer printing, to the display substrate 55. This arrangement has the advantage of using a crystalline semiconductor substrate that provides higher-performance integrated circuit components than can be made in the amorphous or polysilicon semiconductor available on a large substrate such as the display substrate 55.

By employing a multi-step transfer or assembly process, increased yields are achieved and thus reduced costs for the parallel redundant integrated-circuit system 5 of the present invention. Additional details useful in understanding and performing aspects of the present invention are described in U.S. Patent Application Ser. No. 62/148,603 filed Apr. 16, 2015, entitled Micro-Assembled Micro LED Displays and Lighting Elements, the contents of which are hereby incorporated by reference in its entirety.

As is understood by those skilled in the art, the terms "over", "under", "above", "below", "beneath", and "on" are relative terms and can be interchanged in reference to different orientations of the layers, elements, and substrates included in the present invention. For example, a first layer on a second layer, in some embodiments means a first layer directly on and in contact with a second layer. In other embodiments, a first layer on a second layer can include another layer there between.

Having described certain embodiments, it will now become apparent to one of skill in the art that other embodiments incorporating the concepts of the disclosure may be used. Therefore, the invention should not be limited to the described embodiments, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

5 parallel redundant integrated-circuit system
10 component group
11 red-light component group
12 green-light component group
13 blue-light component group
20 active circuit
21 first active circuit
22 second active circuit
23 third active circuit
25 transistor
30 input connection
32 power connection
34 ground connection
36 signal connection
40 output connection
50 integrated circuit/chiplet
51 first integrated circuit
52 second integrated circuit
53 first pixel substrate
54 second pixel substrate
55 backplane/display substrate
60 light emitter
60R red-light emitter/integrated circuit
60G green-light emitter/integrated circuit
60B blue-light emitter/integrated circuit
61R first red-light emitter/integrated circuit
61G first green-light emitter/integrated circuit
61B first blue-light emitter/integrated circuit
62R second red-light emitter/integrated circuit
62G second green-light emitter/integrated circuit
62B second blue-light emitter/integrated circuit
65 redundant full-color pixel
80 controller/display controller
82 column driver
84 memory
90 storage element
90R red storage element
90G green storage element
90B blue storage element
92 driver circuit
92R red driver circuit
92G green driver circuit
92B blue driver circuit
100 provide circuit system step
110 provide controller step
120 provide optical metrology system step
130 provide uniform control signals step
140 measure light output and calibrate step
150 provide calibrated control signals step

What is claimed:

1. A parallel redundant integrated-circuit system, comprising:

a backplane;

a common input connection;

a common output connection;

a first active circuit comprising one or more first integrated circuits disposed on the backplane, the first active circuit comprising an input directly connected to the common input connection and an output directly connected to the common output connection, wherein each first integrated circuit of the one or more first integrated circuits comprises a separate, independent, and distinct substrate; and a second active circuit comprising one or more second integrated circuits disposed on the backplane, the second active circuit redundant to the first active circuit and comprising an input directly connected to the common input connection and an output directly connected to the common output connection, wherein each second integrated circuit of the one or more second integrated circuits comprises a separate, independent, and distinct substrate, wherein each input of the first active circuit is directly electrically connected to a corresponding redundant input of the second active circuit and each output of the first active circuit is directly electrically connected to a corresponding redundant output of the second active circuit, wherein the one or more second integrated circuits are separate and distinct from the one or more first integrated circuits so that the first active circuit and the second active circuit are substantially identically electrically connected to the common input connection and to the common output connection and the first active circuit and the second active circuit are operable in parallel to provide a substantially identical output, and wherein the first active circuit comprises a first light emitter and a first driver circuit that controls the first light emitter and the second active circuit comprises a second light emitter and a second driver circuit that controls the second light emitter.

2. The parallel redundant integrated-circuit system of claim 1, wherein the common input or common output connection is a signal connection.

3. The parallel redundant integrated-circuit system of claim 1, comprising a plurality of common input connections that comprises the common input connection.

4. The parallel redundant integrated-circuit system of claim 1, comprising a plurality of common output connections that comprises the common output connection.

5. The parallel redundant integrated-circuit system of claim 1, wherein the common input connection is directly connected to the common output connection through the first and second active circuits or wherein the first and second active circuits include a signal-transfer element and the common input connection is directly connected to the common output connection through the signal-transfer element.

6. The parallel redundant integrated-circuit system of claim 1, wherein:

the first light emitter is a first red-light emitter that emits red light and the first active circuit further comprises a first green-light emitter that emits green light and a first blue-light emitter that emits blue light;

the first driver circuit comprises a first red driver circuit driving the first red-light emitter, a first green driver circuit driving the first green-light emitter, and a first blue driver circuit driving the first blue-light emitter;

the second light emitter is a second red-light emitter that emits red light and the second active circuit further comprises a second green-light emitter that emits green light and a second blue-light emitter that emits blue light; and the second driver circuit comprises a second red driver circuit driving the second red-light emitter, a second green driver circuit the second green-light emitter, and a second blue driver circuit driving the second blue-light emitter.

7. The parallel redundant integrated-circuit system of claim 1, wherein the first active circuit comprises a first driver circuit that comprises a first bit-to-current converter and the second active circuit comprises a second driver circuit that comprises a second bit-to-current converter.

8. The parallel redundant integrated-circuit system of claim 1, wherein the first active circuit comprises a first storage element and the second active circuit comprises a second storage element.

9. The parallel redundant integrated-circuit system of claim 1, wherein the common input connection, the common output connection, the first active circuit, and the second active circuit form a component group, and the parallel redundant integrated-circuit system comprises a plurality of component groups comprising the component group.

10. The parallel redundant integrated-circuit system of claim 9, wherein the plurality of component groups comprises a second component group and wherein the common output connection of the first component group is directly connected to the common input connection of the second component group.

11. The parallel redundant integrated-circuit system of claim 9, wherein the first active circuit and the second active circuit of each component group of the plurality of component groups each comprise one or more light emitters.

12. The parallel redundant integrated-circuit system of claim 1, wherein:

the first light emitter is a first red-light emitter that emits red light, the first active circuit further comprises a first green-light emitter that emits green light and a first blue-light emitter that emits blue light, the second light emitter is a second red-light emitter that emits red light, and the second active circuit further comprises a second green-light emitter that emits green light and a second blue-light emitter that emits blue light.

13. The parallel redundant integrated-circuit system of claim 12, wherein the parallel redundant integrated-circuit system is a display.

14. The parallel redundant integrated-circuit system of claim 1, wherein each first integrated circuit of the one or more first integrated circuits and each second integrated circuit of the one or more second integrated circuits is a micro-transfer printed integrated circuit.

15. The parallel redundant integrated-circuit system of claim 1, wherein each first integrated circuit of the one or more first integrated circuits and each second integrated circuit of the one or more second integrated circuits comprises an unpackaged bare die.

16. The parallel redundant integrated-circuit system of claim 1, wherein each first integrated circuit of the one or more first integrated circuits and each second integrated circuit of the one or more second integrated circuits comprises a separate, independent, and distinct semiconductor substrate.

17. The parallel redundant integrated-circuit system of claim 2, wherein the signal connection is a clock signal connection, a data signal connection, an analog signal connection, a digital signal connection, or a current-controlled drive signal.

18. The parallel redundant integrated-circuit system of claim 1, wherein the first active circuit comprises two or more first integrated circuits disposed on the backplane and the second active circuit comprises two or more second integrated circuits disposed on the backplane.

19. The parallel redundant integrated-circuit system of claim 18, wherein the first active circuit comprises a first intermediate substrate and the second active circuit comprises a second intermediate substrate, wherein the two or more first integrated circuits are disposed on the first intermediate substrate and the first intermediate substrate is disposed on the backplane, and wherein the two or more second integrated circuits are disposed on the second intermediate substrate and the second intermediate substrate is disposed on the backplane.

* * * * *